United States Patent [19]

Young et al.

[11] Patent Number: 4,910,984

[45] Date of Patent: Mar. 27, 1990

[54] PROGRESSIVE ROLL BENDER

[75] Inventors: Craig Young, Bellevue; Patrick D. McGee, Gobles, both of Mich.

[73] Assignee: J. A. Richards Company, Kalamazoo, Mich.

[21] Appl. No.: 245,042

[22] Filed: Sep. 16, 1988

[51] Int. Cl.[4] ..... B21D 7/024; B21D 7/08

[52] U.S. Cl. ..... 72/7; 72/166; 72/173; 72/217; 72/388

[58] Field of Search ..... 72/7, 166, 173–175, 72/215–219, 321, 388, 387

[56] References Cited

U.S. PATENT DOCUMENTS

| | | | |
|---|---|---|---|
| 1,387,934 | 8/1921 | Montieth | 72/174 |
| 1,602,399 | 10/1926 | Erman | 72/173 |
| 1,874,280 | 8/1932 | Gibbons | 72/173 |
| 2,279,197 | 4/1942 | Hoell | 72/173 |
| 3,373,587 | 3/1968 | Shubin et al. | 72/7 |
| 3,563,283 | 2/1971 | Tufertshiev | 72/387 |
| 4,020,669 | 5/1977 | Gott et al. | 72/217 |
| 4,117,702 | 10/1978 | Foster | 72/7 |
| 4,232,540 | 11/1980 | Cain | 72/173 |
| 4,280,350 | 7/1981 | King | 72/7 |

*Primary Examiner*—Daniel C. Crane

*Attorney, Agent, or Firm*—Price, Heneveld, Cooper, DeWitt & Litton

[57] ABSTRACT

A machine for bending tubular or rod stock into complex, compound shapes has three driven synchronized rollers together with a single shaping roller also synchronously driven. The shaping roller is mounted on an arm pivotally mounted about the shaft of the downstream one of the three rollers and its movements are precisely controlled and effected by a single hydraulic cylinder. The control valve for the valve is entirely operated by a signal supplied from a omputer which has been pre-programmed to effect the formation of the particular shape or shapes desired.

17 Claims, 5 Drawing Sheets

PROGRESSIVE ROLL BENDER

FIELD OF THE INVENTION

This invention relates to machines capable of forming tubular or rod stock into a wide variety of circular, ellipsoiddal, spiral or generally square, rectangular, rhomboidal, or trapezoidal configurations.

BACKGROUND OF THE INVENTION

Machines for shaping, coiling, bending or otherwise forming tubular or rod-shaped materials into numerous configurations have been known for many years. Many machines of varying complexity are available for these purposes, many of which are fully automated and have relatively high production speeds. However, these machines are limited to making of one particular configuration unless the machine is reorganized, that is retooled, to make a different shape. The down time required by some of the machines is substantial, particularly if the adjustment in shape is significant, such as from a square to a triangle or from a spiral to a final product of hexagonal or triangular shape. Furthermore, the machines have had only very limited capacity within which the overall size of the finished product can be varied. Thus, many companies either had to have a number of the machines to satisfy a wide variety of customer requirements or they had to seriously limit the variety of shapes they were capable of manufacturing. In any case, the retooling and reprogramming of a machine from one particular product configuration to another often required substantial down time to complete the changeover. None of the machines has been capable of being rapidly adapted from one product shape to another. None of the machines has been capable of changing from one product shape to another and then been capable of returning to the original shape without substantial retooling procedures. Furthermore, no single machine has been capable of producing a wide variety of shapes and sizes.

BRIEF DESCRIPTION OF THE INVENTION

The invention provides a means by which complex shapes can be formed from rod or tubular stock with the changeover from one shape to another being accomplished without changing the tooling of the machine. The machine is capable of being shifted from making a small part to a large part without changing the tooling of the machine. The machine provides a means of gripping a rod or a tube and by means capable of micropositioning a forming roller, of controlling not only the overall configuration but also the amount, degree and direction of the bend applied to the stock. The particular pattern to which the stock is shaped can be varied and controlled simply by controlling the machine's operating intervals and the position of a single moveable element. Once the control of the moveable element has been programmed, the machine controls the positioning of the stock engaging element in such a way as to produce the shape, size and overall configuration which it has been instructed to create. The changeover from one configuration or one size to another is accomplished without any change in tooling, the change being accomplished by shifting the timing, direction and arc of arcuate movement of a single roller which bears against the stock being fed through a positive drive path. The down time of equipment for tool change and testing is substantially reduced or eliminated and, thus, the cost of manufacturing a wide variety of complex shapes is reduced to such a degree that such shapes are economically practical.

The invention provides a machine which can be readily programmed to take maximum advantage of the physical characteristics of the particular stock to be formed on it. By providing positive support for the stock during the bending operation, the stock can be shaped without distortion of the stock's cross section and without harmful stressing of the metal.

DESCRIPTION OF THE PREFERRED EMBODIMENT

Figure 1:
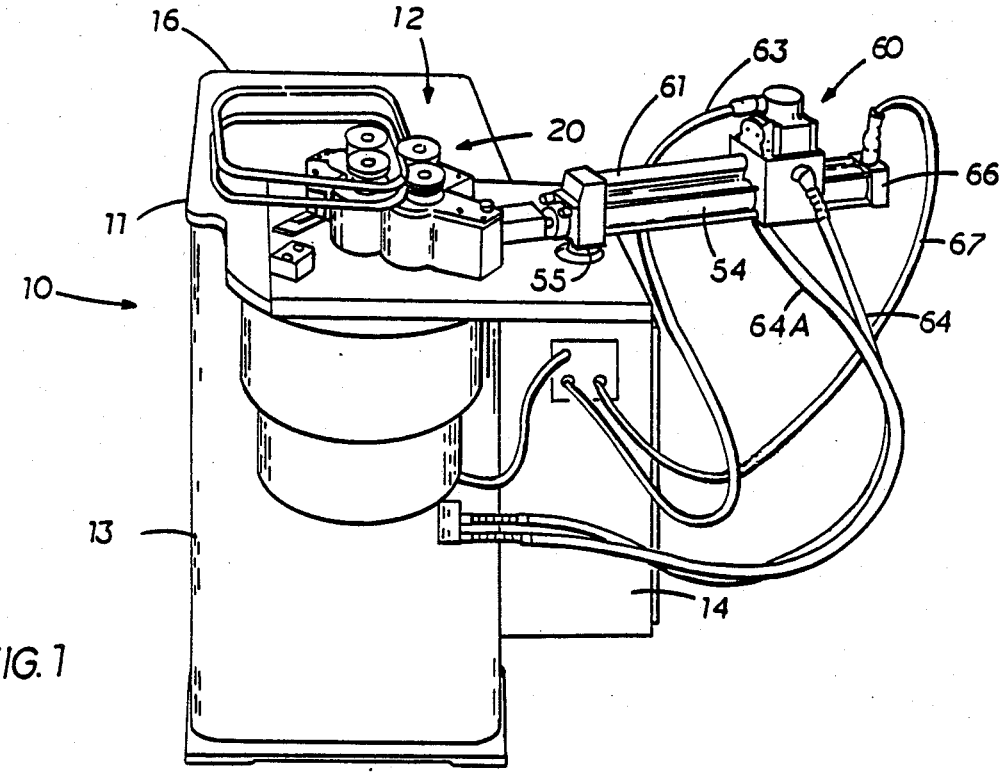
FIG. 1 is an oblique view of a machine incorporating this invention.
Figure 10:
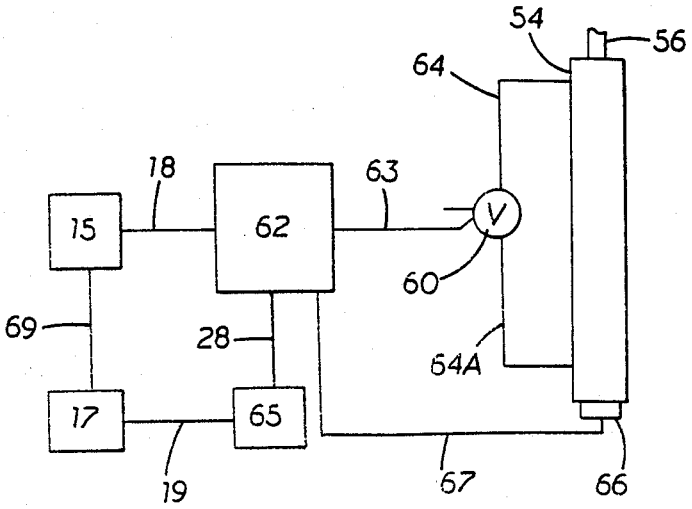
FIG. 10 is a schematic of the system controlling the machine's bending operation.

Referring to FIG. 1, the numeral 10 identifies a tube or rod bender or shaper having a supporting platform 11 for the bending mechanism 12. The platform 11 is provided with a suitable support 13. The support 13 has a control cabinet 14 which is connected to controller 62 (FIG. 10) for controlling the operation of the bender. The operation of the entire equipment is governed by the information which has been provided to the computer 15 and provides the basic program for the entire operation. As will be explained and illustrated subsequently, this particular arrangement and selection of equipment is illustrative only because various other items of equipment and arrangements can be substituted within the framework of the invention.

The platform 11 has a flat top surface 16 on which is mounted a roller assembly 20 which is the actual tube or rod gripping and forming mechanism. For the sake of simplicity, hereinater the stock which is shaped by the invention will be referred to as "tubular". However, it should be understood that the invention is not limited to shaping tubular stock because it also will shape rod or stock of other cross-sectional shapes such as square, so long as the shape of the stock is symmetrical about its centerline. It is also necessary that the peripheral groove in the rollers be shaped to properly seat and support the stock.

Figure 7A:
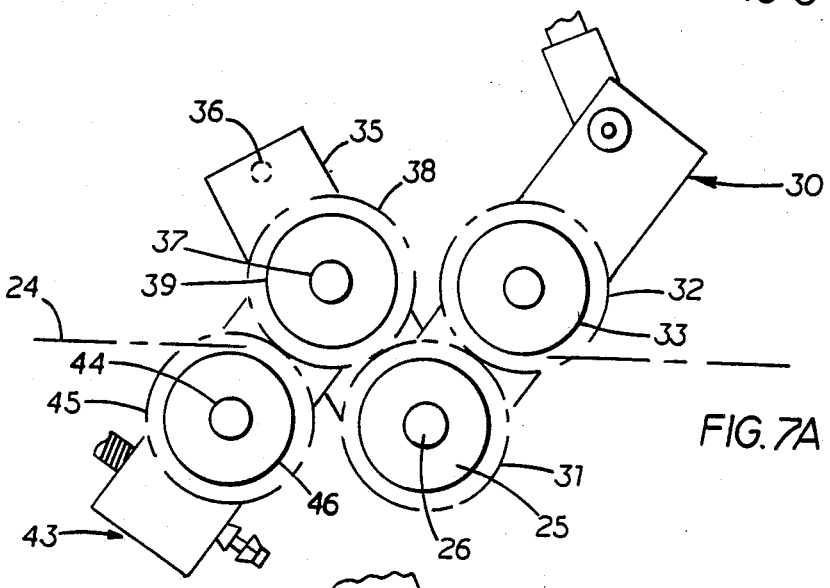
FIG. 7A illustrates the relationship of the rollers shown in FIG. 7 but with the bottoms of roller channels shown in solid lines.
Figure 7:
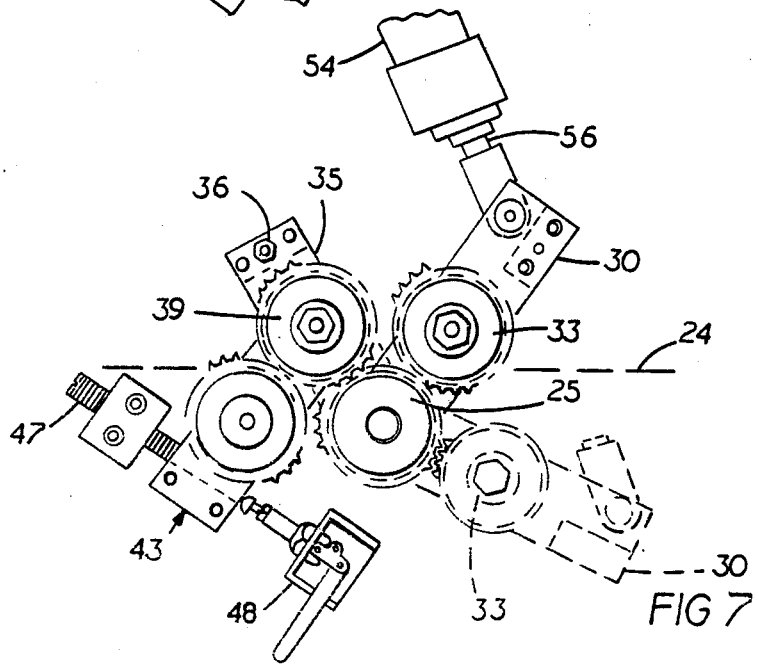
FIG. 7 is a plan view of the rollers in initial stock receiving position and illustrating in phantom the limit of pivotal movement of the forming roller.
Figure 8:
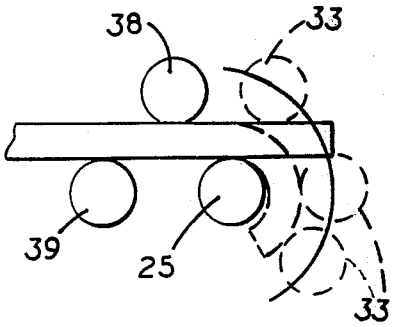
FIG. 8 is a diagrammatic plan viw of the path of movement of moveable forming roller.
Figure 9:
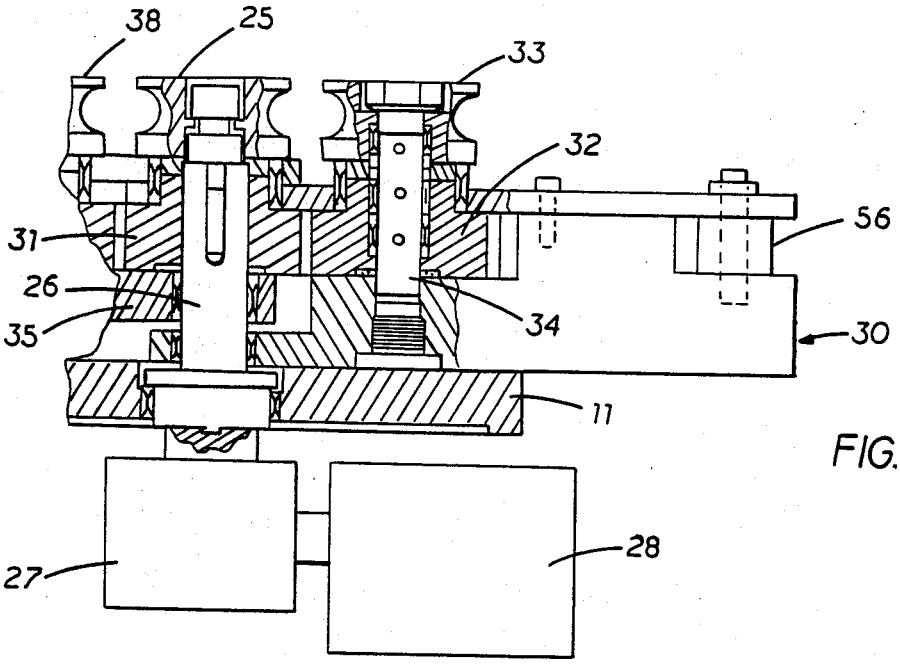
FIG. 9 is a fragmentary, sectional elevation view taken along the plane IX—IX of FIG. 7.

The rollers of the roller assembly are arranged in pairs (FIG. 7). The roller pairs are arranged to provide a path 24, shown in broken lines in FIGS. 7 and 7A, between them. Roller 25 is mounted on the upper end of a shaft 26 which extends through the platform 11 and below the platform is connected a gear drive 27 to a hydraulically powered prime mover 28 (FIG. 9). This roller is hereafter referred to as the "drive roller". Pivotally mounted about the shaft below the drive roller is one end of an arm 30. Also mounted on and driven by the shaft 26 is a spur drive gear 31.

Mounted on the arm 30 is a second spur gear 32 meshed to the gear 31. The gear 32 is keyed to a forming roller 33, both of which are mounted for rotation about a shaft 34. Thus, the roller 33 is synchronizally driven with the roller 25.

Figure 5:
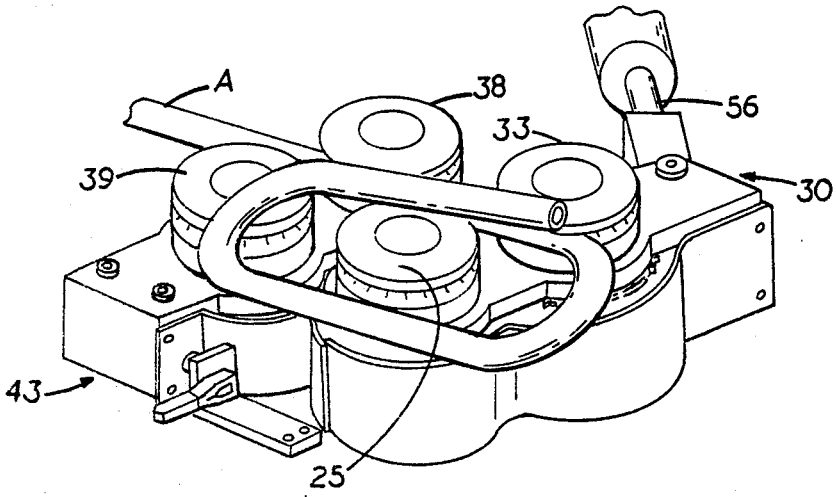
FIG. 5 is a view similar to FIG. 4 showing the position of the forming rollers when the sides of greater dimension are formed in a generally rectangular coil.
Figure 6:
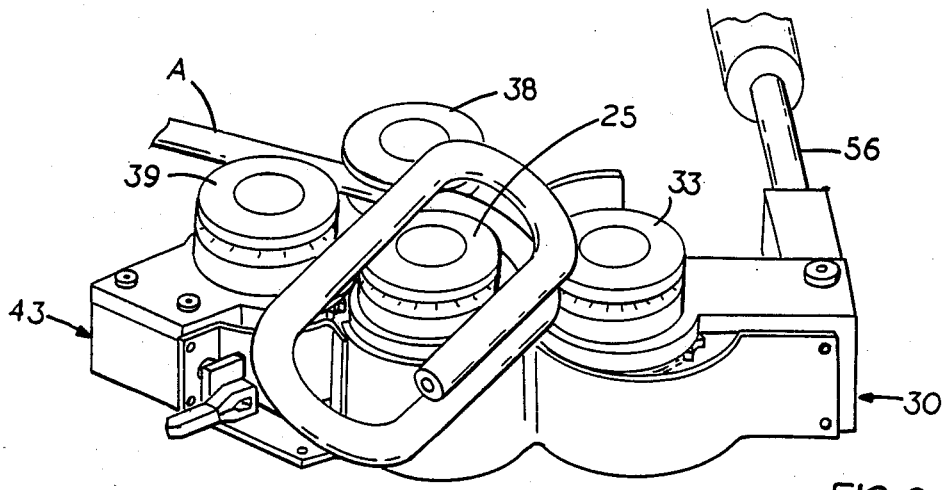
FIG. 6 is a view similar to FIG. 5 showing the forming rollers when the third bend of a coil is being formed.

The roller 39 is mounted to an arm 35 (FIGS. 5 and 7A) through one end of which rotatably passes the shaft 37 for the roller 39. The outer end of the arm is secured to the platform by suitable means such as a stud bolt 36 thus preventing any pivotal motion about the shaft 26. Secured to the fixed arm is a shaft 37 which mounts the spur gear 38 and its associated squeeze roller 39. The gear 38 and roller 39 are interconnected for simultaneous rotation by suitable means, such as a key, in the same manner as the gear 32 and roller 33. The gear 38 meshes with and is driven by the drive gear 31 but is always spaced from the forming roller 33.

Pivotally mounted about the shaft 37 is one end of the clamp arm 43 which, in its release position, is substantially parallel to and extends in a direction opposite to that of the arm 30. The clamp arm mounts a shaft 44 which in turn rotatably mounts the spur gear 45 and the clamp roller 46 which is keyed to the gear 45. The gear 45 meshes with and is driven by the gear 38 and, thus, through the gear 38 is synchronously driven from the drive gear 31.

The clamp arm has only a very limited arc of movement. This movement is such that, at its position of maximum movement away from the drive roller, a tube path 24 is created which is only slightly larger than that necessary to slidably receive the stock to be formed for the purpose of initially introducing the stock into the path 24. This position is made adjustable by the adjustable stop 47 (FIG. 7). During operation, the free end of the clamp arm 43 is pressed against the stop 47 by the toggle lock 48.

To provide a path for the stock 60 to be shaped, the rollers 25, 33, 39 and 46 each have a peripheral groove or channel 50 (FIG. 2), the recess of which has a radius to seat closely about the stock. If the stock is of non-circular cross-section, the shape of this groove must be changed to accommodate this fact. However, the depth of the channel 50 is equal to or only slightly less than the radius of the external surface of the stock. Channels of this depth can be utilized because, along the tube path 24, the peripheries of the rollers are always spaced apart at least a little more than the diameter of the stock channels of the rollers. This arrangement permits the walls of the channels to provide positive support to and firmly grip the walls of the stock and thus apply sufficient frictional grip to positively drive the stock as it is being forced through the bending process. This is very important because any slippage between the stock and the rollers will result in an improperly shaped product.

The arcuate position of the shaping roller 33 is the sole means by which stock is shaped. Its position is controlled by the hydraulic cylinder 54 which is supported on the pivot 55 at its end adjacent the arm 30 (FIG. 1). The hydraulic cylinder has a piston 56 the end of which is pivotally attached to the outer end of the arm 30. Movement of the piston is in response to the valve assembly 60 (FIG. 1) which controls the admission and release of hydraulic fluid to and from the cylinder 54. The valve assembly 60 is connected to a fluid port behind the piston of the valve assembly and to a fluid port at the front of the piston through the conduit 61. Operation of the valve 60 is governed by the controller 62 through the line 63 and hydraulic fluid is supplied and exhausted through the hoses 64 and **64*a*. A valve controller 62 capable of operating this equipment is model LESA1-EDC 100 manufactured by Aeroquip Corporation, Jackson, Mich., which is illustrated only diagrammatically in FIG. 10 and is mounted in a pedestal separate from the platform. Connected to the valve controller 62 by the cable 18 is computer or programmable logic controller 15. A suitable unit for this purpose is the digital controller SLC 150 manufactured by Allen Bradley, Milwaukee, Wis. The computer 15 controls only the operation of the gear drive 17 which is done through the cable 69. The lineal movement of the stock by the gear drive, that is degrees of rotation of the gears, is recorded by the encoder 65 in units of 12 seconds of arc comprising each unit through information furnished by means of the interconnecting shaft 19 from the gear drive 17. This information is provided to the controller 62 and to the computer 15 through the line 28**.

The controller 62 is equipment having computer capability and performs the central function of coordinating the operations of both the computer 15 and, thus of the gear drive, and also that of the valve 60. The operation of the valve 60 by the controller 62 is responsive to the information which has been programmed into the controller and the information provided to the controller by the encoder 65 concerning the operation of the gear drive 17 which controls the lineal movement of the work stock. Information concerning the amount and direction of movement of the piston 56 is provided by means 66 mounted within the cylinder 54 which magnetically reads incremental movements of the piston rod. Because the equipment must react rapidly and very accurately, the increments of movement which are read are small, such as 0.001 inch. For this purpose, a reader 66 manufactured by Aeroquip TJ Corporation, Jackson, Mich. has proven to have the necessary degree of reliability and precision. The signals produced by the reader 66 are transmitted to the controller 62 through the cable 67.

The valve 60 which controls the position of the piston 56 is of the two-way servo type. It is important to the function of the bending mechanism 12 that this valve be of the rapid, micro-response type capable of coordinated, substantially instantaneous response, effecting very precise control of the flow of hydraulic fluid in either direction. This is essential to accuracy in shaping the stock. These valves must also be capable of rapid flow of a substantial quantity of hydraulic fluid when a major change in the shape of the stock is desired. An important characteristic of these valves is the speed of response to eliminate, as much as possible, the lapse time between receipt of a signal and completion of the response to the signal both as to volume of flow and the length of the interval of flow.

To make any of the particular shapes illustrated in FIGS. 11–16 or others, the information necessary to coordinate the operations of the gear drive 17 controlled by the computer 15 and of the piston 56 controlled by the valve 60 is programmed into the controller 62 which centralizes the operation of the entire equipment.

OPERATION

To prepare the bending mechanism to receive the stock 24, the piston 56 is fully retracted. Also the toggle lock 48 is released permitting the clamping roller 46 to shift counterclockwise so that the stock A can be passed between the clamping roller 46 and the squeeze roller 39 and be inclined to the axis 24 just enough to permit the end to be passed between the drive and shaping rollers 25 and 33. If there is resistance to the operation, the stock A can be fed between the drive roller 25 and the shaping roller 33 by operating the rollers at a low speed just sufficient that the end of the stock makes full contact with the peripheral grooves of these rollers. The toggle lock is then closed, pivoting the clamping roller 46 into a position which causes the stock to make firm, driving contact with the bottom and sides of the grooves of all of the rollers. The final position of the clamping roller can be precisely adjusted by extending or retracting the stop 47 and the end of the toggle lock 48. This arrangement also provides adjustment for stock of different sizes.

Information concerning the particular shape to be produced is then or has previously been fed into the controller 62 and the computer 15 from a programming board. The controller 62, having been appropriately prepared to process the directions it receives from the program then manipulates the valve 60 to control the position of the forming roller 33. The controller 62 is also provided with information concerning the lineal speed of movement of the stock by the encoder 65. Preferably, this is a constant, but it is possible to make this variable with appropriate control of the speed of the hydraulic drive 28 or by use of a variable speed control means, not illustrated, between the prime mover and the shaft 26. Thus, once the controller 62 has been properly programmed, the operation of the bending mechanism is then thereafter totally controlled by the coordinated operations of the controller 62 and computer 15. In response to commands from the controller 62, the piston 56 is advanced or retracted by the valve 60. The computer 15 in coordination with the controller 62 and information from the encoder 65 through the line 69 controls the operation of the gear drive 17. The controller 62 accuately controls the timing, direction and amount of the piston's actuation in precise coordination with the rate and direction of lineal movement of the stock.

Figure 2:
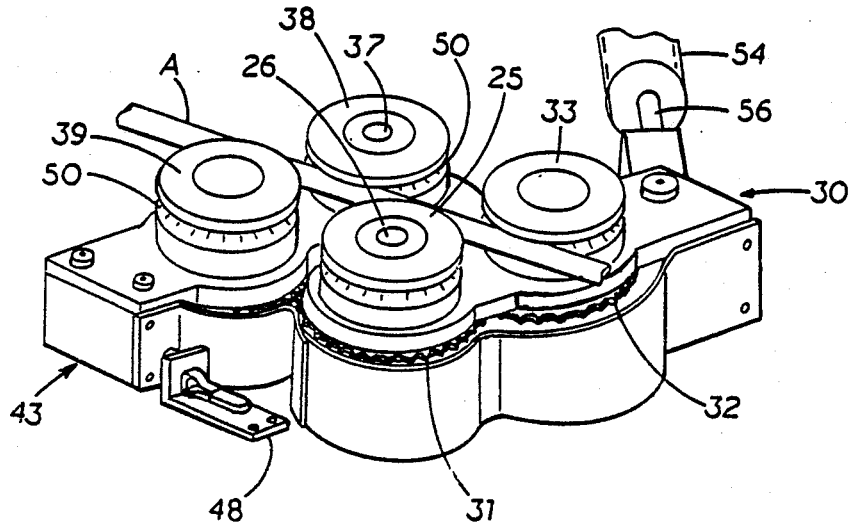
FIG. 2 is an oblique plan view of the positions of the forming rollers of the invention as they are positioned when the stock is initially introduced into the machine.
Figure 3:
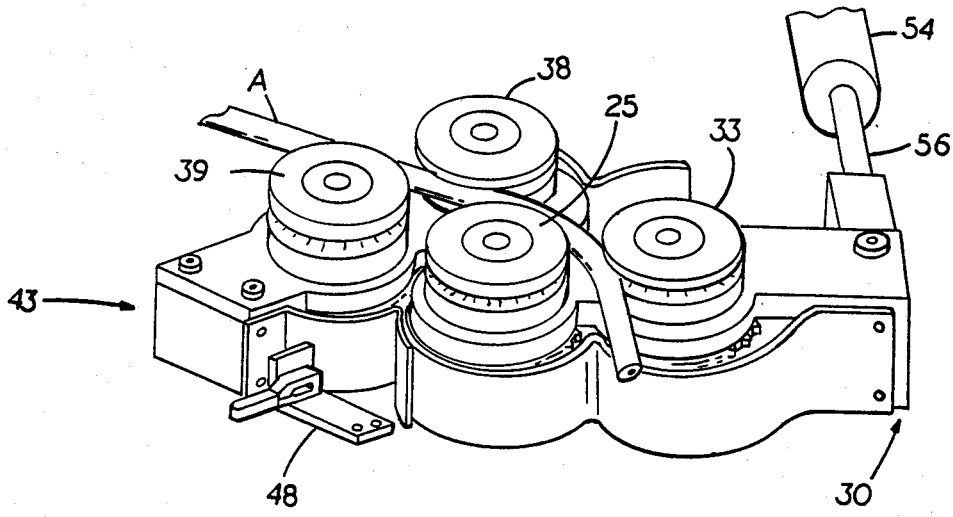
FIG. 3 is an oblique plan view of the forming rollers and of the stock when the machine initiates bending of the stock.
Figure 4:
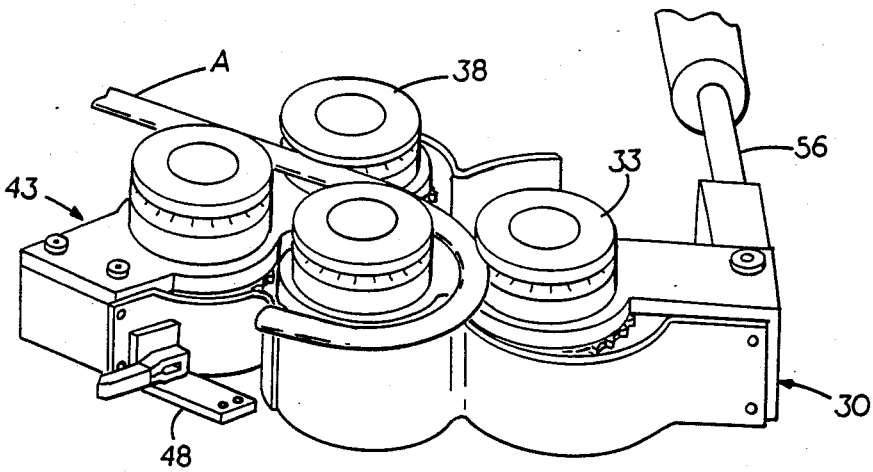
FIG. 4 is an oblique plan view of the forming rollers and the stock during the next progression of the forming.

When the shaping roller 33 is in its initial or starting position, as illustrated in FIG. 2, the stock will pass through the machine without change. However, even a small increment of movement of the roller 33 to the right, as illustrated in FIG. 3, will initiate bending of the stock. The sharpness of the bend can be increased until the minimum inside radius is only a small amount greater than that of the root of the groove of the drive roller 25. The minimum radius of curvature is governed by the diameter of the stock, the metal from which the stock was made and the root diameter of the rollers with which the machine is equipped.

Figure 11:
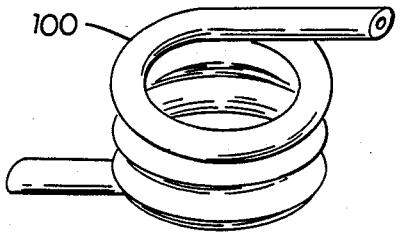
FIGS. 11–16 illustrate various shapes which can be formed on the machine of this invention.
Figure 12:
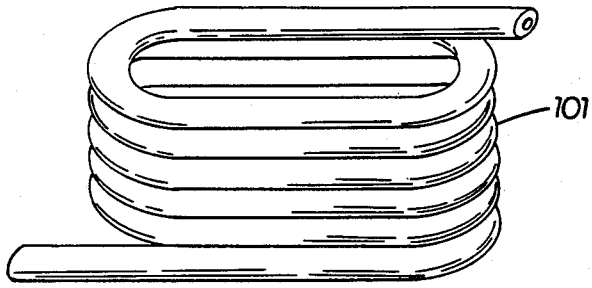
Figure 13:
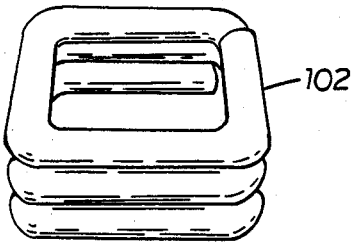
Figure 14:
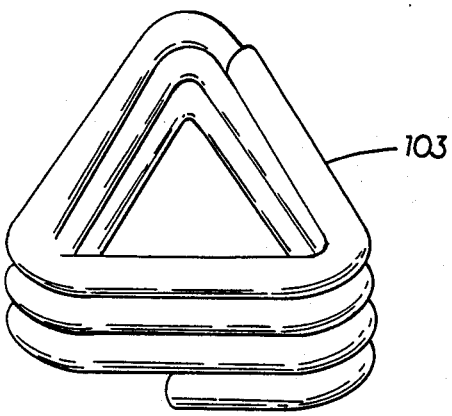
Figure 15:
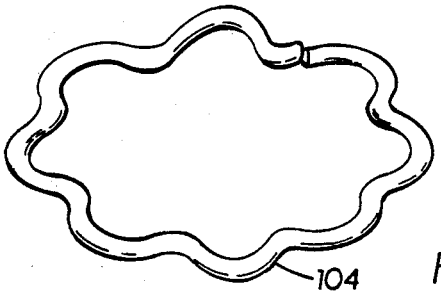
Figure 16:
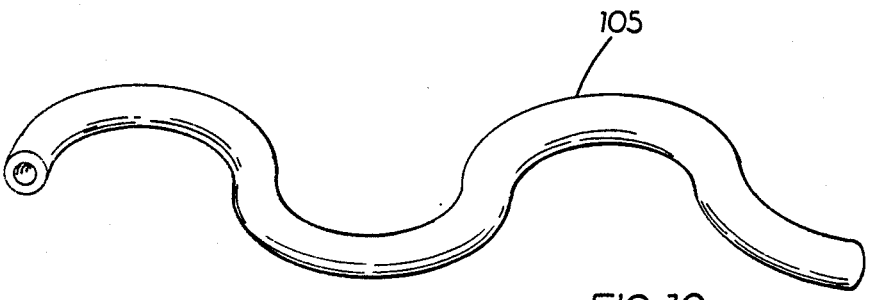

By alternately advancing and retracting the shaping roller 33 a large variety of shapes can be created. By controlling the rate of advancement and retraction in coordination with the lineal spped at which the stock is fed through the equipment, the shape can be varied almost without limit. Thus, by maintaining the shaping roller 33 at a fixed degree of advancement, a coil 100 will be formed, the diameter of which is governed by the amount the roller has been advanced (FIG. 11). By sequentially advancing and retracting the shaping roller twice followed by the rollers being left in fully retracted position or a specific interval between each such sequence, an elongated loop 101 is created (FIG. 12). By use of the same procedure except by providing a period of identical duration between each advance and retraction operation of the roller 33, a square 102 can be formed (FIG. 13). By decreasing the length of the interval during which the roller 33 is being shifted from retracted position to fully advanced, the radius of the corner thus formed is controlled. Thus, the shorter the interval during which the roller 33 is in movement, the more abrupt the bend and thus the smaller the radius of the corners. Also by increasing the length of the interval during which the roller remains in a selected, advanced position, the greater the bend. Thus, by increasing the interval over that required to form a square, a triangular coil 103 can be formed (FIG. 14). By proper programming of the operation of the cylinder to manipulate the piston 56, a wide variety of complex shapes can be made, such as the ring 104 of FIG. 21 and the undulating shape 105 of FIG. 16. The machine can be so programmed that it will bend a single length of pipe and rod into several different shapes, such as a circular coil such as illustrated in FIG. 11 followed by a portion of the stock being formed into a square such as illustrated in FIG. 13. By programming the movement of the forming roller 33, even more complex shapes, such as prolate or oblate ellipzoids and polygons can be formed.

The use of a single element to perform all of the bending functions eliminates the necessity for coordination between plural elements working in concert and reduces the problems of time and magnitude coordination and further of maintaining accuracy in the coordination. The use of a single mechanism to bend the work pieces greatly simplifies the equipment without reducing its versatility. While it is possible to provide means to vary the lineal speed at which the stock is moved along the path 24, this is not necessary if the stock being processed is always uniform. It might be desirable to vary the lineal speed of the stock when the invention is used to make shapes having long straight sections although it does add another factor complicating the control of accuracy. One of the important features of the invention is that the use of four rollers arranged in the particular configuration which has been described, using only one roller movable to effect the bending, makes precision much more readily controlled. This is essential to producing a final configuration to within tolerances not previously possible. Also, because the forming is done under circumstances in which the stock is positively and closely supported during the ending, the stock can be shaped into complicated configuration without distortion of the cross-sectional shape. This is very important to many applications for tubing.

Providing the ablity to vary the lineal speed of the stock would be valuable and, in fact, could be essential in cases in which stock of metals of significantly different characteristics or of different wall thicknesses or when both rod and tube are to be formed on the same machine. Since to produce a shaped product without significant variation of its cross-sectional dimension, it is necessary to cause the metal to flow to account for the difference in arc length between the inside and outside walls of the stock. Further, this must be done while the stock is so held that it wll neither wrinkle along the inner radius of the bend nor lose its circular shape by distorting sideways nor stretch to the point of rupture along the outer radius. The ability of metal to have adequate flow to do this depends upon the degree of tension and compression to which it is subjected, together with the length of the time period required for the flow to occur as well as the characteristics of the metal itself. These can be accounted for to a significant degree by controlling the time lapse allowed for the flow to occur. The variation in time lapse has to be provided by varying the lineal speed of the stock.

It is essential that the cylinder 56 be operated hydraulically because liquids are capable of more rapid and precise response to changes in pressure and flow rates than pneumatics because of their lack of compressibility. This is essential to provide the speed and accuracy of response which is basic to this invention.

Having described a preferred embodiment of our invention, it will be recognized that various modifications of it can be made without departing from its principles. Such modifications are to be considered as included in the hereinafter appended claims unless these claims, by their language expressly state otherwise.

We claim:

1. Means for shaping rod or tubular stock by bending, said means comprising: first, second and third rollers defining a stock path; each roller having a circumferential channel of a cross-sectional size and shape to seat and provide bottom and side support for the stock, said first, second and third rollers being connected by gears and means driving said rollers at identical speeds said rollers being arranged in a triangular pattern with two rollers including said first and second rollers on one side of the stock and said third roller being intermediate said two rollers and on the opposite side of the stock; so that said third roller is offset relative to said first and second rollers said second roller being at the discharge end of the path of travel through said means; an arm mounted for pivotal movement about the axis of said second roller, a fourth roller rotatably mounted on said arm on the same side of the stock path as said third roller and means driving said fourth roller at the same speed as said other rollers; in one pivotal position of said arm, a straight passageway for tubular stock being defined between the first, second, third and fourth rollers; said rollers all being so arranged along said passage that the stock is frictionally gripped with sufficient pressure that it will be moved lengthwise when said rollers are rotated, means for pivoting said arm and fourth roller about the axis of said second roller at a uniform radius to cause said stock to be bent and travel a curved path the radius of which is determined by the length of the arc of travel of said arm about said first roller and the length of the arc imposed on the stock being determined by the time the fourth roller remains in such advanced position while the stock is being propelled through said shaping means.

2. The means for shaping rod or tubular stock described in claim 1 wherein a support element is mounted for pivotal movement about the axis of said first roller, said third roller being mounted on said support element and moveable therewith toward and away from said straight passageway, means for shifting said support element and third roller toward said straight passageway to press stock to be bent into positive driving engagement with said first roller and both said second and third rollers.

3. The means for shaping tubular stock described in claim 1 wherein a fluid activated servomechanism is operatively connected to said arm for pivoting said arm and fourth roller through an arc such that the minimum inside radius of the bent stock can be only slightly greater than the radius of the root of the stock receiving groove of the second roller; said means for pivoting said arm being a hydraulically actuated piston, said servomechanism being capable of precisely controlling the movement of said piston.

4. Means for shaping rod or tubular stock by bending, said means comprising: a plurality of stock gripping rollers forming a path for stock to be bent, said rollers being arranged in pairs with the rollers of each pair being on opposite sides of and initially forming a straight path for stock passed between them, all of said rollers being interconnected for simultaneous rotation at identical peripheral speeds and means for driving them, one roller of one of said pairs being a clamping roller movable between release and clamping positions and when in clamping position effecting driving engagement between the stock and the other three rollers; an arm mounted to and for arcuate pivotal movement about the axis of the other roller of the other pair, the one roller of said other pair being remote from and on the same side of the stock path as said clamping roller and mounted on said arm and serving as a bending roller, hydraulically actuated means connected to said arm for effecting its pivotal movement about said other roller of said other pair from its position forming said straight path to a position in which the minimum inside radius of the bend imparted to the stock is approximately that of the root of the stock contacting surface of said other roller of said other pair, means for controlling both the quantum and direction of movement of said hydraulically actuated means for determining the location and the radius of curvature applied to the stock.

5. Means for shaping rod or tubular stock by bending as described in claim 4 wherein the rollers of one of said pairs are offset lengthwise of said path with respect to each other and to both rollers of the other pair, the other roller of said one pair being a squeezer roller and located between the rollers on the opposite side of said stock path, the location of said squeezer roller being stationary lengthwise with respect to said stock path.

6. Means for shaping rod or tubular stock by bending as described in claim 5 wherein means are provided for mounting said clamping roller for pivotal movement about the axis of said squeeze roller, means for locking said clamping roller in a position to urge the stock into driving engagement with all of the rollers.

7. Means for shaping rod or tubular stock by bending as described in claim 4 wherein said hydraulically actuated means is a piston, information means for reading incrementally the amount of lineal movement of said piston in either direction, valve elements for controlling the direction and rate of flow of hydraulic fluid acting on said piston and programmable means for converting the readings of the information means into control signals and control means responsive to the signals for controlling the actuation said valve elements as to both quantum and direction of flow of the hydraulic fluid.

8. Means for shaping rod or tubular stock by bending as described in claim 7 wherein the angular velocity of said rollers is constant.

9. Means for shaping rod or tubular stock by bending as described in claim 4 wherein a counter is provided for measuring the length of the arc of rotation of the stock engaging rollers and information integrating means for coordinating the measurements so made with the actuation of the hydraulically actuated means for controlling the radius and the length of arc of the bend applied to the stock.

10. Means for bending elongated rod or tubular stock said means including four stock engaging rollers forming a stock path with two rollers on each side, said rollers all being interconnected for simultaneous rotation at identical speeds, one of said rollers being moveable in an arcuate path of constant radius the point of generation of which is concentric with an adjacent one of said rollers on the opposite side of said path, an hydraulically operated piston for arcuately moving said one roller, a valve for controlling the amount and direction of movement of said piston, first means for measuring the direction and length of movement of said piston means as it arcuately moves said one roller, second means for measuring the length and direction of the arc of rotation of said rollers, a programmable coordination controller connected to said valve, said roller drive means and both said first and second measuring means for determining the shape impressed on the stock by the movable roller.

11. The means for bending as described in claim 10 wherein said second means records the arc length in units of twelve seconds each.

12. The means for bending described in claim 11 wherein the first means reads the lineal movement of the piston in units of 0.001 of an inch each.

13. The method of shaping an elongated length of stock of circular cross section including the steps of clamping said stock in a straight path between four rollers, two on each side of the stock with both rollers on one side of the stock being offset lengthwise of the stock with respect to both rollers on the other side of the stock, rotating the rollers to propel the stock lengthwise, pivoting the last roller downstream of movement of the stock in a path of uniform radius about the axis of the next adjacent roller on the opposite side of the stock to change the shape of the path traced by the stock, the maximum arc of movement of said last roller being approximately 90° along a radius centered on the axis of said adjacent roller on the opposite side of said stock path for determining the shape imparted to the stock by the arc length and rate of arcuate movement of the one roller with respect to the angular velocity of the rollers, driving all of the rollers at a constant and identical angular velocity.

14. The method of shaping an elongated length of stock as described in claim 13 including the further step of varying the direction and length of arcuate movement of the one roller.

15. The method of shaping an elongated length of stock of rod or tubular cross section between rollers including the steps of providing two pairs of rollers to form a straight path for stock to be shaped between the pairs, moving one roller of the pair on one side of the stock to a release position further spaced from the next adjacent roller on the opposite side of the path only enough that the width of the path is sufficient that the stock is not held against lineal movement as it is initially inserted, inserting the stock, shifting the one roller to arrange the rollers such that the path is straight and all of the rollers make positive driving frictional contact with the stock with the stock clamped between said one roller of one of the pairs and both rollers of the other pair with the remaining roller of the other pair positioned at the downstream end of the stock path, driving all of the rollers at an identical peripheral velocity to forcibly propel the stock in a downstream direction along the straight path, bending the stock solely about the downstream one of said other pair of rollers for determining the shape imparted to the stock solely by adjusting the length of the arc of arcuate pivotal movement of said remaining roller of the other pair along a path of uniform radius about the adjacent roller of said one pair in coordination with the angular velocity of the rollers, driving the rollers to propel the stock at a constant linear velocity.

16. Means for shaping tubular stock by bending as described in claim 4 wherein said control means includes a digital memory means for storing information indicative of a predetermined pattern to be applied to the stock, said control means being responsive to said memory means.

17. Means for shaping rod or tubular stock by bending, said means comprising: a plurality of stock gripping rollers, said rollers being arranged in pairs with said pairs initially forming a straight path for stock between them, all of said rollers being interconnected for simultaneous rotation at identical peripheral speeds and means for driving them, one roller of one of said pairs being a clamping roller moveable with respect to said path for pressing the stock into driving engagement with the two rollers on the opposite side of the stock, one roller of the other pair being a pivot roller forming a mandrel about which said stock is bent, an arm mounted for arcuate movement about the axis of said pivot roller, the other roller of said other pair being mounted on said arm at a fixed distance from the axis of said pivot roller and serving as a bending roller; hydraulically actuated means connected to said arm for effecting its pivotal movement about said axis from a position in which the bending roller is aligned with said straight path to a position in which the minimum inside radius of curvature imparted to the stock is approximately that of the stock contacting surface of said pivot roller; means for controlling both the quantum and direction of movement of said hydraulically actuated means for determining the location, radius and length of arc of curvature applied to the stock.

* * * * *